US005662095A

United States Patent [19]

Matsuo

[11] Patent Number: 5,662,095

[45] Date of Patent: Sep. 2, 1997

[54] PLUG CAP FOR INSERTION INTO A BORE

[75] Inventor: Yoshiyuki Matsuo, Yokkaichi, Japan

[73] Assignee: Sumitomo Wiring Systems, Ltd., Japan

[21] Appl. No.: 516,390

[22] Filed: Aug. 17, 1995

[30] Foreign Application Priority Data

Oct. 14, 1994 [JP] Japan ..... 6-249626

[51] Int. Cl.[6] ..... H01T 13/04

[52] U.S. Cl. ..... 123/143 C; 174/152 G; 248/56; 277/212 C; 277/213

[58] Field of Search ..... 123/169 PA, 169 PH, 123/143 C, 647; 174/152 S, 152 G, 153 G, 65 G; 248/56; 277/212 C, 213, 215, 207 A, 29, 212 FB

[56] References Cited

U.S. PATENT DOCUMENTS

| | | | |
|---|---|---|---|
| 3,243,240 | 3/1966 | Arthur | 174/153 G |
| 4,637,358 | 1/1987 | Yano et al. | 123/169 PA |
| 4,703,136 | 10/1987 | Hauff | 174/152 G |
| 4,906,202 | 3/1990 | Germ | 439/127 |
| 5,377,640 | 1/1995 | Kobayashi | 123/143 C |
| 5,454,573 | 10/1995 | Nijland | 277/215 |

*Primary Examiner*—Andrew M. Dolinar

*Attorney, Agent, or Firm*—Jordan B. Bierman; Bierman, Muserlian and Lucas LLP

[57] ABSTRACT

A plug cap freely mountable on or removable from an elongated bore, especially for a spark plug in internal combustion engines or the like. The plug cap is provided with a rain cover, seal, and a pipe-holding portion. The latter has, on its internal face, a circular groove and a plurality of protrusions projecting radially inwardly. These grooves and protrusions, and the deflection thereof on insertion into the bore, give elasticity to the seal and to the pipe-holding portion. When the plug cap is pressed into the bore, there is no curling up of the pipe-holding portion, thereby ensuring a reliable seal. After insertion, the protrusions of the pipe-holding portion, which are formed integrally with the seal, are pressed against the external face of the ignition pipe, so that the latter can be held more reliably.

14 Claims, 3 Drawing Sheets

PLUG CAP FOR INSERTION INTO A BORE

This application claims the priority of Japanese Application 6/249626, filed Oct. 14, 1994.

The present Invention relates to a plug cap that can be freely mounted onto and removed from a bore, particularly an elongated bore which houses a spark plug on an internal combustion engine. Although the Invention will be described in connection with an internal combustion engine, it is to be understood that it is applicable to any opening requiring a seal.

BACKGROUND OF THE INVENTION

A plug cap of the above type is described in Japanese Utility Model Publication Showa 61/61778. FIG. 3 hereof shows such a known plug cap, in which ignition pipe 19 is fitted at one end into a spark plug and receives the plug cap on an external circular face at the other end. The above-mentioned plug cap also incorporates a rain cover and pipe holder 15 fits on the external circular face of ignition pipe 19. Seal 12 is provided between the external circular wall of pipe holder 15 and the internal circular wall adjacent the opening of elongated bore 21 adapted to receive the spark plug. Narrow gap 26 is formed between pipe holder 15 and seal 12. Plug cap 22 is provided with peripheral cover 11 at its external face. This cover engages above and around the opening via ring-shaped rim 17 surrounding the opening. Ignition pipe 19 receives ignition cable 18 which passes through the rain cover. Plug cap 22 thus fits over elongated bore 21, for example, in vehicle engine 20 so that it can be freely mounted or removed.

In this prior art device, proper sealing is ensured by covering bore 21 with peripheral cover 11. Gap 26 between pipe holder 15 and seal 12 provides the resilience required for easy insertion of the plug cap into bore 21, and also prevents any compressive strain from forming in the plug cap during insertion. However, pipe holder 15 and seal 12 are partially separated from each other by gap 26; hence, seal 12 is very thin. Consequently, when plug cap 22 is inserted into bore 21, it tends to curl up at the periphery or otherwise deform, resulting in bore 21 no longer being sealed properly.

SUMMARY OF THE INVENTION

It is, therefore, an object of the present Invention to provide a plug cap in which the seal is prevented from curling up when it is inserted into the bore, while the elasticity needed to facilitate the insertion operation and to avoid compressive strain in the plug cap after insertion can still easily be obtained.

To solve the above-mentioned problem, there is provided a plug cap for an internal combustion engine comprising an elongated bore housing a spark plug and an ignition pipe, the plug cap comprising a rain cover portion, a pipe-holding portion, a seal, and a through hole. The pipe-holding portion and the seal are preferably integrally formed and the pipe-holding portion comprises a recessed circumferential groove in an inner surface thereof and an underlying base portion having a plurality of protrusions, the protrusions being disposed at intervals around the circumference of the surface of the pipe-holding portion and projecting radially inward, thereby gripping the ignition pipe. Preferably, the seal is somewhat larger than the opening of the elongated bore so that the plug cap fits snugly in the opening while being freely mountable on and removable therefrom. To this end, the plug cap may be made of an elastic material and may be provided with a peripheral cover depending from its side wall and covering the surface portion around the opening of the elongated bore. The peripheral cover may be adapted to cooperate with a rim surrounding the opening adjacent thereto, so that the cover engages the rim.

The ignition pipe may comprise an outwardly flared lip at the end proximal to the plug cap, and the plug cap comprises a recessed portion on its inner surface which engages the lip when the plug cap is pressed into the elongated bore. In a preferred form of the Invention, the protrusions at the base of the pipe-holding portion are configured to grip a reduced diameter portion of the outer wall of the ignition pipe. The plug cap may also comprise a vent and include an internal passageway whereby the ignition cable can enter the ignition pipe and thereby connect with the spark plug. According to a further aspect of the present Invention, there is provided a method of sealing an opening in an elongated bore housing a spark plug in an internal combustion engine by use of the plug cap described herein.

In the accompanying drawings, constituting a part hereof, and in which like reference characters indicate like parts, FIG. 1(*a*) is a cross-sectional side view of the plug cap of the present Invention;

DETAILED DESCRIPTION OF THE INVENTION

Figure 2:
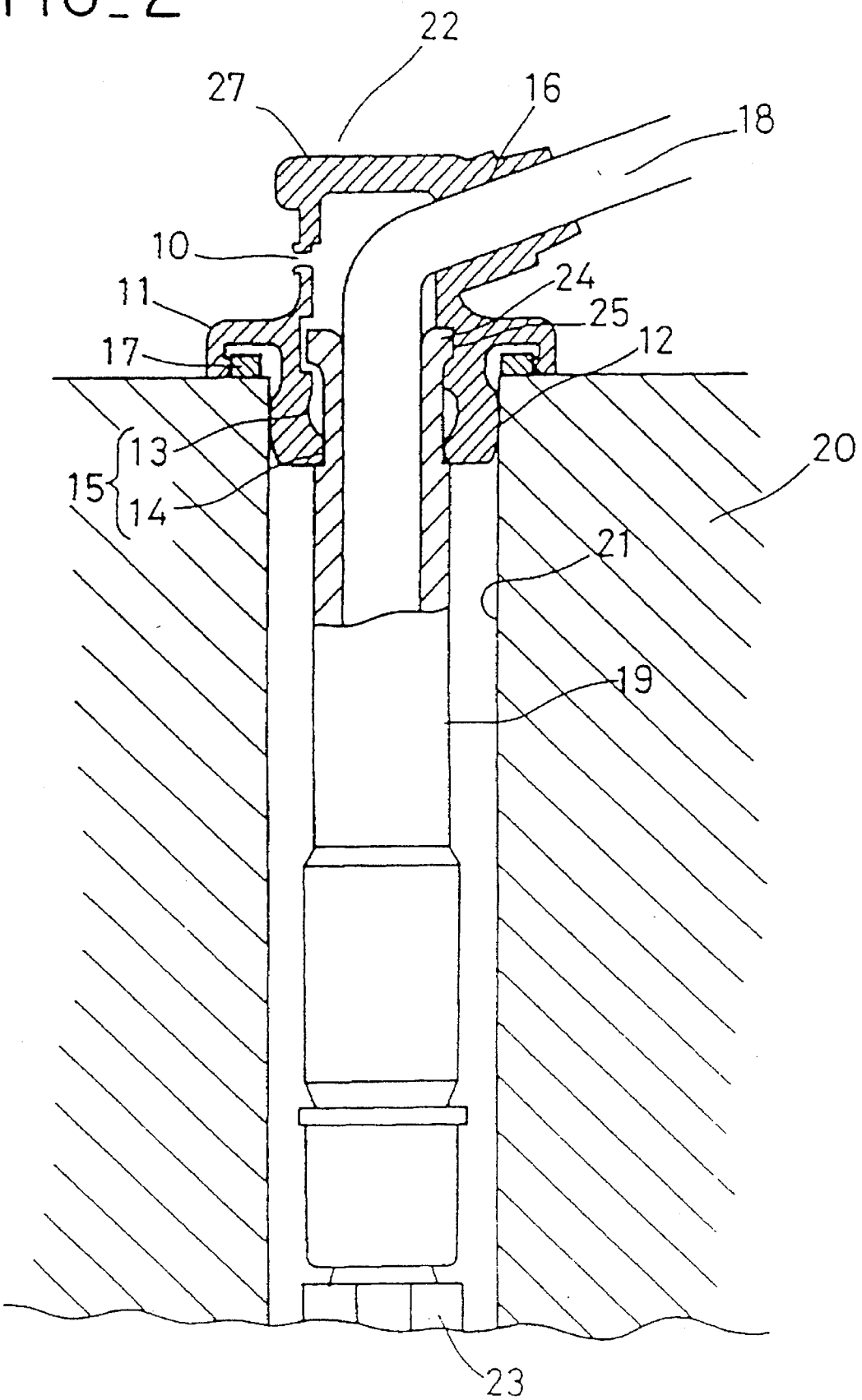
FIG. 2 shows the plug cap of FIG. 1 mounted on an engine.
Figure 3:
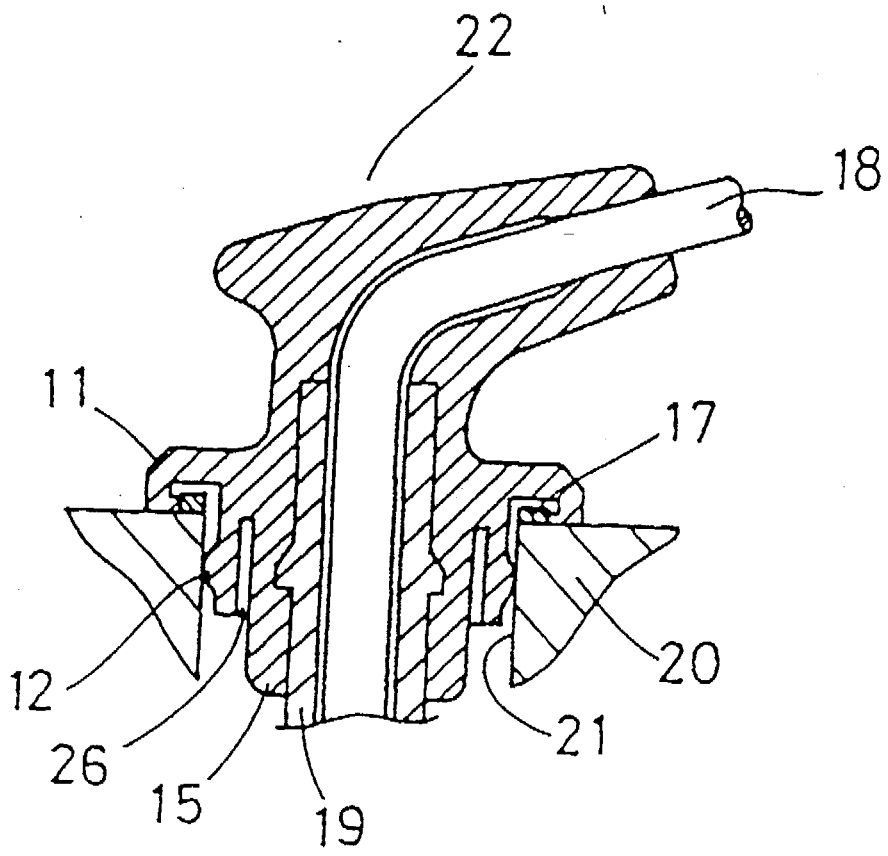
FIG 3 PRIOR ART
FIG. 3 is a plug cap according to the prior art.

Referring to FIG. 2, engine 20 has bore 21 to accommodate spark plug 23 at the base portion thereof. Ignition cable 18, one end of which is connected to spark plug 23, extends upwardly through bore 21. Ignition pipe 19 is provided with a first end fitted onto spark plug 23 and a second end vertically above spark plug 23 at the level of plug cap 22.

Plug cap 22, preferably made of an elastic material such as rubber, is fitted on the second end of ignition pipe 19. A hollow circular part of plug cap 22 fits around bore 21. An inner surface of a hollow circular part fits over ignition pipe 19, and thereby forms pipe holding portion 15. The outer surface of the hollow circular part is press fit inside bore 21, and thereby forms seal 12. Pipe-holding portion 15 and seal 12 thus constitute two sides of the same integrated hollow part without any gap or slit present between them, in contrast to the prior plug cap. Pipe-holding portion 15 is also provided with a circumferential recessed groove 13 on its inner face. A part of pipe-holding portion 15 underlying groove 13 is configured so as to form a plurality of protrusions 14 disposed circumferentially at intervals around its inner surface, the protrusions projecting radially inwardly (see FIGS. 1(*a*) and 1(*b*)). Seal 12 is adapted to close bore 21, having an external diameter which is slightly larger than the internal diameter of the latter.

The cap is provided with a circular flange portion extending from its side wall above seal 12 forming peripheral cover 11 which fits over rim 17 which surrounds the opening of bore 21. Rain cover 27 is formed at the top central portion of the plug cap, directly above bore 21. Ignition cable 18 is received in ignition pipe 19 and projects outwardly through side hole 16 at the upper portion of the plug cap, in the vicinity of rain cover 27. Preferably, rain cover 27 is provided with air evacuation vents 10 at appropriate locations. Thus, when the air inside bore 21 is heated or otherwise tends to expand, it exits through vents 10.

Figure 1A:
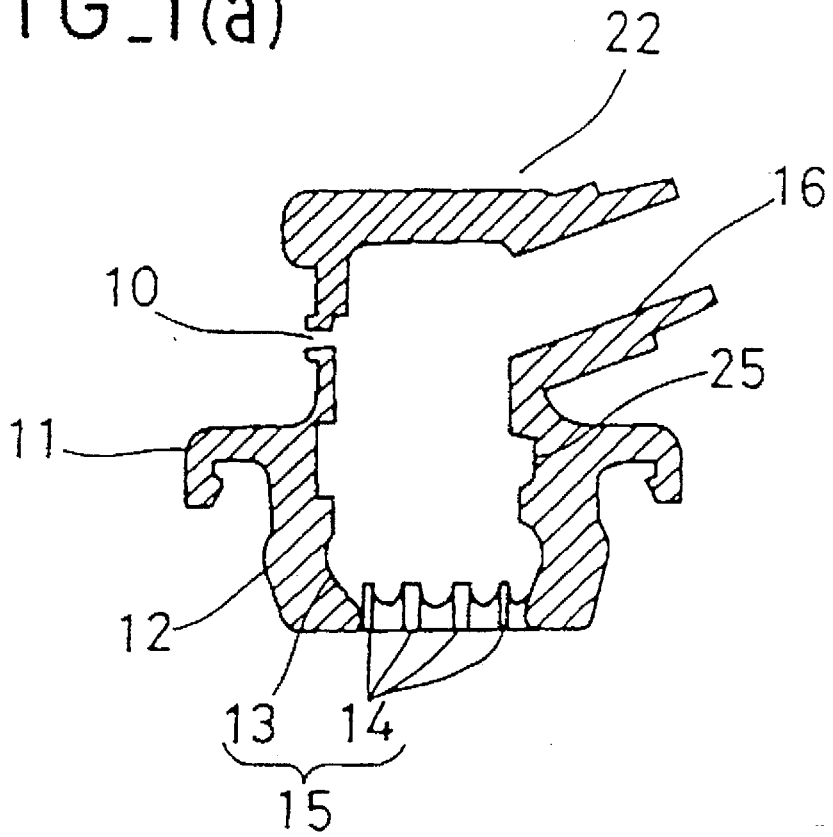
FIG. 1(*b*) is a view from the underside of the plug cap of FIG. 1(*a*)
Figure 1B:
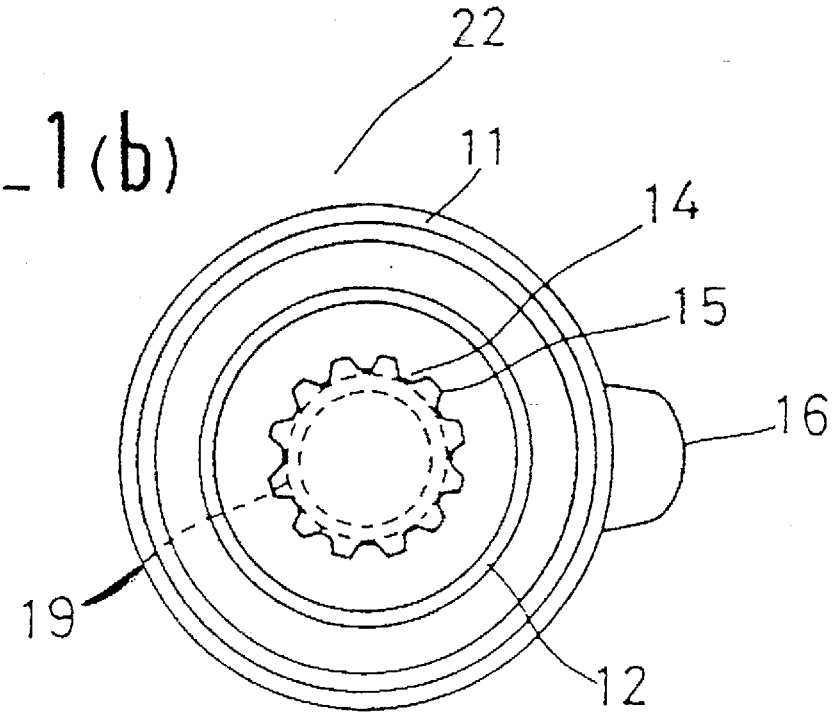

With reference to FIGS. 1 and 2, pipe-holding portion 15 of plug cap 22 fits over the second end of ignition pipe 19 before plug cap is fully received into bore 21. The second end of ignition pipe 19 carries flared annular lip 24 which fits into receiving slot 25 located just above pipe-holding portion 15. The projecting parts of protrusions 14 of pipe-holding portion 15 come into contact with the outer wall of ignition pipe 19, as shown in dotted lines in FIG. 1(*b*), so that pipe-holding portion 15 grips ignition pipe 19 firmly.

As shown in FIG. 2, the first end of ignition pipe 19 fits on spark plug 23 located at the base of bore 21. Seal 12 is pressed into the opening of bore 21, and peripheral cover 11 rests on rim 17 surrounding the opening. The cap is thereby firmly seated while remaining freely mountable on, or removable from, bore 21. Groove 13 of pipe-holding portion 15 also surrounds ignition pipe 19. Thus, when plug cap 22 is inserted into bore 21, seal 12 is resiliently deflected inwardly to provide a snug fit with its inner wall, while protrusions 14, just beneath this groove, are pressed against ignition pipe 19, thereby forcing the base of the cap into a compressed state. Because seal 12 is deflected inwardly, protrusions 14 are pressed firmly onto the outer surface of ignition pipe 19, whereby the latter is reliably held. Groove 13 cooperates with protrusions 14, thereby conferring the required elasticity on plug cap 22 and pipe-holding portion 15, while reducing the force necessary to insert the plug cap into the bore. This elasticity also makes it possible to avoid the formation of an axial compressive strain in the plug cap upon insertion.

A remarkable feature of the Invention is that there is no need to form a gap between seal 12 and pipe-holding portion 15, which thus allows seal 12 to be thicker than with the prior art caps. Consequently, when plug cap 22 is inserted into ignition plug bore 21, there is no curling-up of seal 12, and bore 21 is thereby reliably sealed. As a result, there is no need to increase the overall size of the plug cap, and optimum bore sealing conditions can be maintained while also meeting size restrictions. Further, since the diameter of seal 12 is larger than the opening of bore 21, when plug cap 22 is press-fitted into bore 21, the outwardly bulging part of seal 12 is pushed radially inwardly. Because pipe-holding portion 15 integral with seal 12, pipe-holding portion 15 and protrusions 14 formed thereon are pressed against the external face of the ignition pipe. This integrated configuration, in combination with the groove-and-protrusion structure of pipe-holding portion 15, further reinforces the grip on ignition pipe 19. Peripheral cover 11 on bore 21 is an optional part of the Invention which can be best implemented when a corresponding rim 17 surrounds the bore opening. Such a configuration helps to maintain a reliable seal against the ingress of water, dust, and the like.

While only a limited number of specific embodiments of the Invention have been expressly disclosed, it is, nonetheless, to be broadly construed and not to be limited except by the character of the claims appended hereto.

What I claim is:

1. A generally cylindrical plug cap adapted for insertion into an insertion position in a bore complementary thereto, said bore containing a generally cylindrical element axially centered therein, said plug cap comprising a seal adapted to bear against an internal wall of said bore when said cap is in said insertion position, and a holding portion having an inner surface, an annular groove in said inner surface, and a plurality of circumferentially spaced apart protrusions extending radially inwardly from said inner surface and adapted to bear against said element when said cap is in said insertion position, said bore containing a spark plug for an internal combustion engine and said element is an ignition pipe.

2. The plug cap of claim 1 wherein said seal and said holding portion are integral.

3. The plug cap of claim 1 wherein said seal has a diameter larger than that of said bore.

4. The plug cap of claim 1 which is of elastic material.

5. The plug cap of claim 1 comprising a through hole adapted to permit an ignition cable to extend therethrough, one end of said cable being in electrical contact with said spark plug.

6. The plug cap of claim 1 wherein said cap has an external side wall which is outside said bore when said cap is in said insertion position, a peripheral cover extending radially outwardly and from said side wall, whereby at least a portion of an area adjacent said bore is covered thereby.

7. The plug cap of claim 6 wherein an upstanding rim is provided which surrounds an opening of said bore, said peripheral cover in contact with said rim when said cap is in said insertion position.

8. The plug cap of claim 7 wherein said peripheral cover extends downwardly to form an engaging portion, said engaging portion being radially outward of said rim.

9. The plug of claim 8 wherein an engaging diameter of said engaging portion is slightly smaller than that of said rim, whereby said engaging portion grips an outer wall of said rim.

10. The plug cap of claim 1 wherein said ignition pipe, at its end proximal to said cap when said cap is in said insertion position, extends radially outward to form a flared portion, a circumferential recess in a radially inward wall of said cap adapted to receive said flared portion.

11. The plug cap of claim 10 wherein said flared portion is out of said bore.

12. The plug cap of claim 10 wherein said circumferential recess grips said flared portion.

13. The plug cap of claim 1 comprising a vent having an air opening outside said bore said vent extends from a space between said bore and said ignition pipe through a longitudinal groove between adjacent said circumferentially spaced-apart protrusions to an exterior of said plug cap.

14. A generally cylindrical plug cap adapted for insertion into an insertion position in a bore complementary thereto, said bore containing a generally cylindrical element axially centered therein, said plug cap comprising a seal adapted to bear against an internal wall of said bore when said cap is in said insertion position, and a holding portion having an inner surface, an annular groove in said inner surface, and a plurality of circumferentially spaced apart protrusions extending radially inwardly from said inner surface and adapted to bear against said element when said cap is in said insertion position, said plug cap having a vent having an air opening outside said bore.

* * * * *